US005439208A

United States Patent [19]

Moser et al.

[11] Patent Number: 5,439,208

[45] Date of Patent: Aug. 8, 1995

[54] TURNOVER-SEQUENCER STAGING APPARATUS AND METHOD

[75] Inventors: James R. Moser, Easton; Thomas E. Bieber, Coplay; David M. Skvoretz, N. Catasauqua, all of Pa.

[73] Assignee: Bell & Howell Phillipsburg Company, Allentown, Pa.

[21] Appl. No.: 336,116

[22] Filed: Nov. 4, 1994

[51] Int. Cl.[6] ..... B65H 5/00

[52] U.S. Cl. ..... 271/225; 271/182; 271/186; 271/270; 271/272

[58] Field of Search ..... 271/225, 184, 185, 186, 271/182, 270, 272; 226/197

[56] References Cited

U.S. PATENT DOCUMENTS

| | | | |
|---|---|---|---|
| 1,630,713 | 5/1927 | Meyer | 226/197 X |
| 3,215,428 | 11/1965 | Rehm | 271/71 |
| 3,548,783 | 12/1970 | Knapp | 226/197 |
| 4,078,489 | 3/1978 | Davis | 271/184 X |
| 4,266,762 | 5/1981 | Kramer et al. | 271/225 |
| 4,367,997 | 1/1983 | Schweingruber | 271/184 |
| 4,790,126 | 12/1988 | Boeckmann | 226/197 X |
| 4,879,571 | 11/1989 | Plasscheart | 271/225 |
| 5,158,278 | 10/1992 | Auf der Mauer | 271/270 |
| 5,316,199 | 5/1994 | Hansen et al. | 226/197 |
| 5,333,851 | 8/1994 | Kulpa | 271/225 |
| 5,362,039 | 11/1994 | Kusters | 271/225 |

FOREIGN PATENT DOCUMENTS

| | | | |
|---|---|---|---|
| 634551 | 7/1963 | Belgium | 271/186 |
| 1394541 | 2/1965 | France | 271/186 |
| 2529103 | 1/1976 | Germany | 271/186 |
| 0057759 | 5/1979 | Japan | 271/225 |
| 0140450 | 11/1980 | Japan | 271/225 |
| 0021667 | 1/1987 | Japan | 271/225 |
| 0117536 | 5/1990 | Japan | 271/186 |
| 0152845 | 6/1990 | Japan | 271/186 |
| 4041359 | 2/1992 | Japan | 271/225 |
| 2151 | 1/1903 | United Kingdom | 226/197 |
| 280782 | 11/1927 | United Kingdom | 226/197 |
| 729330 | 7/1952 | United Kingdom | 226/197 |

*Primary Examiner*—H. Grant Skaggs
*Assistant Examiner*—Carol L. Druzbick
*Attorney, Agent, or Firm*—Millen, White, Zelano, & Branigan

[57] ABSTRACT

A turnover-sequencer staging apparatus for sheets comprises: a receiver, a turnover-sequencer, and a staging segment. The receiving device receives at least two side-by-side sheets and supplies these to the turnover-sequencer wherein the sheets are overturned and rerouted in a substantially orthogonal direction, the relationship between sheets having been converted to sequential whereby the sheets become disposed seriatim and imbricated. The overturned and rerouted seriatim-imbricated sheets are selectively de-imbricated in the staging segment by separation of selected consecutive sheets. Separation is effected by braking or stopping of the conveying motion of the trailing one of two consecutive sheets. In other embodiments, separation can be accomplished by changing the speed of conveying of one of two consecutive sheets; either by speeding up of the leading sheet or by slowing down of the trailing sheet.

20 Claims, 5 Drawing Sheets

TURNOVER-SEQUENCER STAGING APPARATUS AND METHOD

This invention relates to apparatus and method for the handling of sheets or forms, for instance in the processing of high-volume business mail. Such processing, for instance, can include stuffing of envelopes with inserts (in sheet form), and hence can involve insert conveying, turning over, accumulating, folding, collecting, and the like. In particular, this invention relates to the turning over of side-by-side conveyed sheets, changing of the sheet conveying direction, sequencing of the initially side-by-side conveyed sheets to consecutive sheets conveyed seriatim and imbricated, and the staging of selected sheets to selectively de-imbricate the shingled sheet sequence.

Important functions required in the processing of high-volume mail include conversion from conveying sheets in side-by-side relation to sequential relation (along a transport path) and, further, selective separation and collection of sheets in various sets for insertion in individual envelopes for eventual mailing.

Sheets are often provided by devices delivering two or more sheets in parallel. For instance, in high-speed processing, many systems have printers or copiers that deliver web material requiring cutting and/or bursting (along perforations) to obtain individual pages. Two or more sheets in side-by-side relationship ("two-up") result therefrom. Also, other operations can inherently result in the feed of sheets on a conveyor in parallel or side-by-side relationship. However, preparation of respective sets of sheets for mailing requires sequential processing and, hence, merging of parallel-conveyed into seriatim-conveyed sheets. Furthermore, collecting and composing selected sets of sheets involves selective separating and/or de-imbricating of conveyed sheet sequences.

Requirements for equipment to be capable of more and more processing tasks and to operate at increasingly higher celerities with high reliabilities and short downtimes have commonly increased mechanical and electrical complexity and, hence, cost. For example, complex mail processing systems have been assembled from individual devices providing specific individual functions and the devices have been serially connected by conveying mechanisms. As a result, such systems have become somewhat large, complex, difficult to service, liable to failure, and expensive.

For instance, needs for handling of side-by-side-conveyed sheets and for conversion to seriatim-conveyed sheets (while keeping the same leading edges leading), turnover of sheets, imbricating and selectively de-imbricating and separating sheets and composing of sets of sheets have conventionally required assembly of individual function devices. Thus, it could have necessitated several individual machines interconnected by conveying mechanisms; such as a serializer machine including right angle turning to keep leading edge orientation, a turnover machine, a shingling accumulator, a selective de-shingling machine and/or a stager.

The following includes prior art devices of relevance to the instant invention. Auf der Mauer (U.S. Pat. No. 5,158,278) discloses employment of clutches 70 and 72 to stop movement of imbricated products 48 located on a first conveyor to produce a gap between these products and similar products located on a second conveyor (column 11, line 51, to column 13, line 64). Schweingruber (U.S. Pat. No. 4,367,997) discloses employment of a clutch 79 (FIGS. 6–8) and braking mechanism 2 including a pressure roller 63 and a roll 45 which cooperatively brake or slow down blanks located on a first conveyor (column 5, line 50 to column 6, line 65). Davis (U.S. Pat. No. 4,078,489) illustrates a turnover device 14 (FIGS. 3, 4) which effects a 90 degree turn and inversion of a workpiece between conveyors 12 and 16. Knapp (U.S. Pat. No. 3,548,783) discloses a curved guide 98 (FIG. 5) for inverting and redirecting a paper by 90 degrees (column 3, line 44 to column 4, line 10). Rehm (U.S. Pat. No. 3,215,428) discloses a curved guide 5 to invert a sheet and change its conveying direction by 90 degrees.

Okayama (Japanese patent 62-21667) discloses cylindrical guide members 5,6,7 to provide a change of transfer direction of sheet 1 by 90 degrees and further discloses arcuate belt-guide surfaces 5A,6A,7A for the change of sheet transfer direction and for reversal of the sheet. Mashiba (Japanese patent 2-152845) discloses a paper conveyor having a turnover roller 5 oriented at 45 degrees to the conveying direction for changing paper-conveying direction by 90 degrees and for the simultaneous turnover of the sheet. Koizumi (Japanese patent 54-57759) discloses a paper feeder that changes the direction of blank forms and performs a form inversion by rollers and endless belts and a cylindrical guide surface (at location 13) that is tilted with respect to the feed direction.

Other prior art patents that include aspects of relevance to the present invention are: U.S. Pat. Nos. 4,879,571 (Plasscheart); 4,266,762 (Kramer et al.); Meyer (1,630,713); and Japanese patent 55-140450 (Sugano). The references cited herein are incorporated by reference in their entirety.

In view of the foregoing, it is a feature of the present invention to provide improved apparatus and a method for a turnover-sequencer staging of reduced complexity and cost and, more particularly, to provide 180-degree turnover, 90-degree rerouting, and simultaneous merging or conversion of parallel side-by-side-conveyed sheets into seriatim-conveyed form, together with the selective staging of sheets for selective separating of particular sheet sequences into selected sets of sheets.

SUMMARY

In accordance with principles of the present invention, there is provided a turnover-sequencer staging apparatus for receiving side-by-side sheets, for overturning these sheets and simultaneously redirecting their conveying motion by 90 degrees, for simultaneously converting the conveying of parallel sheets into seriatim-imbricated form, and for the selective staging of selected sheets to obtain separate sets of sheets.

The turnover-sequencer staging apparatus comprises means for receiving side-by-side-conveyed sheets, means for overturning and rerouting the sheets, means for converting the side-by-side relationship to a sequential relationship, and means for selectively de-imbricating and separating sheets into particular sets.

BRIEF DESCRIPTION OF THE DRAWINGS

The foregoing and other objects, features, and advantages of the invention will be apparent from the following more particular description of preferred embodiments of the invention, as illustrated in the accompanying drawings in which like reference numerals refer to like parts throughout different views. The drawings are schematic and not necessarily to scale, emphasis instead being placed upon illustrating principles of the invention.

DESCRIPTION OF THE PREFERRED EMBODIMENTS

Figure 1:
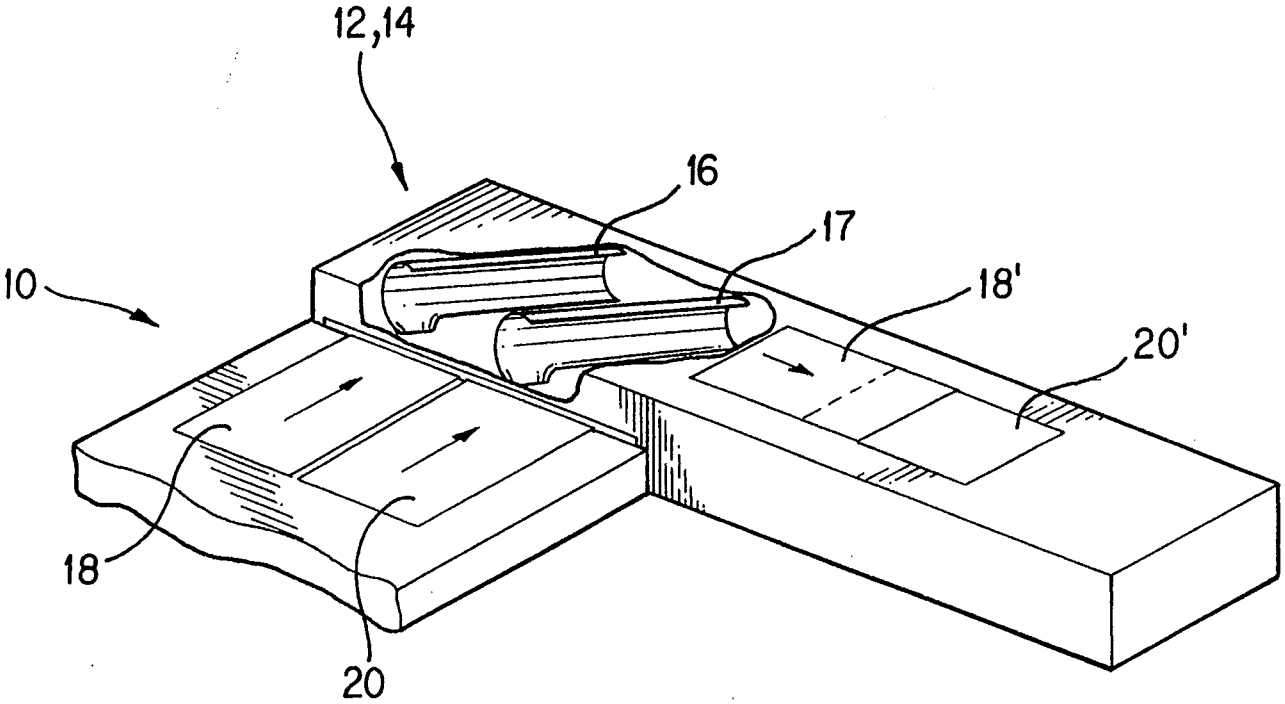
FIG. 1 is a fragmental, schematic, perspective view of a portion of an apparatus according to principles of this invention.
Figure 2:
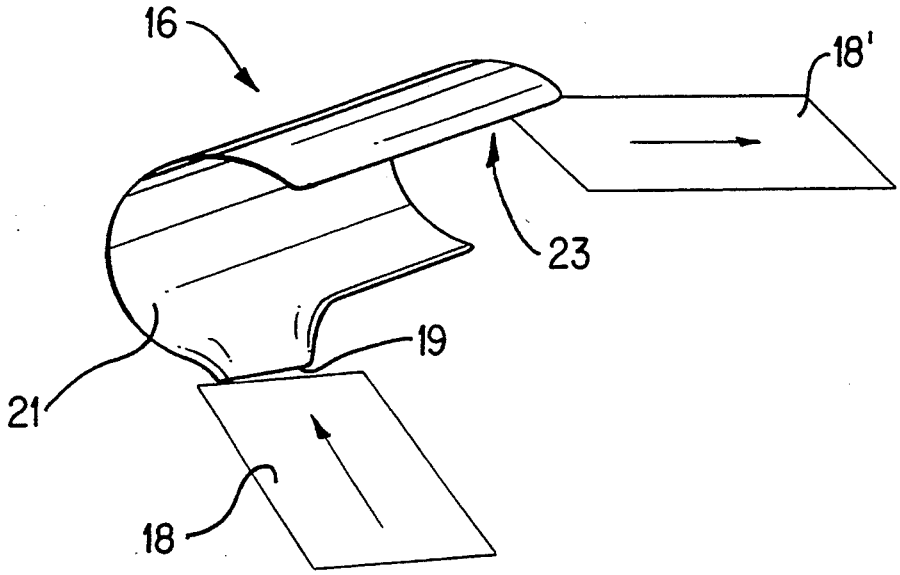
FIG. 2 is a fragmental, schematic, perspective view of a portion of the apparatus shown in FIG. 1.

Referring to FIGS. 1 and 2 of the drawings, an embodiment of the invention is schematically shown. The apparatus comprises: means 10 for receiving at least two sheets in a side-by-side relationship; means 12 for overturning the sheets (upside-down) and simultaneously rerouting them in their conveying path substantially orthogonally; and, comprised in means 12, converting means 14 for converting the side-by-side relationship of the sheets to a sequential relationship with the at least two sheets disposed seriatim and imbricated.

Receiving means 10 transports at least two sheets side-by-side (in a plane) to overturning and rerouting means 12 by conventional sheet conveying mechanisms. Receiving means 10 can include means for cutting or slitting a single-width sheet into two (or more) side-by-side sheets. Overturning and rerouting means 12 is shown here to comprise two turnover tubes 16 and 17 which serve to overturn and reroute sheets 18 and 20, respectively.

A turnover tube 16 is shown enlarged in FIG. 2 in approximately the same orientation and location with respect to an entering sheet as illustrated in FIG. 1. In FIG. 2, an entering sheet 18 is received and conveyed into turnover tube 16 substantially at a 45 degree angle. Turnover tubes 16 and 17 are identical to one another. An entering sheet 18 is fed in at entry lip 19 along the bottom inner surface 21, curls in a helical path along the inner surface, and exits from turnover tube 16 again substantially at a 45 degree angle at the upper inner surface 23 as exiting sheet 18'. Hence, the sheet is curled over or turned over and rerouted by 90 degrees along its conveying path.

Figure 4:
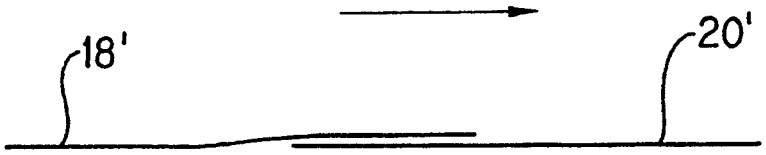
FIG. 4 is a schematic, side view of sheets in imbricated relationship as indicated in FIG. 1.

Referring again to FIG. 1, it will be apparent that two sheets 18 and 20 fed side-by-side in parallel into overturning and rerouting means 12 will exit in overlapped, shingled or imbricated form as shown by sheets 18' and 20'. Both sheets are curled through their respective turnover tubes simultaneously (synchronously), yet sheet 18 has a longer path to cross over turnover tube 17. Thusly, the leading edge of sheet 18 is transported over trailing portions of sheet 20 (while sheet 20 is issuing from turnover tube 17). Consequently, exiting sheets 18' and 20' not only exit sequentially (seriatim), but in imbricated form along their further conveying path, as illustrated in FIGS. 1 and 4.

It will be appreciated that rerouting can be achieved to the right (as shown) or the left side by a side-reversed layout of respective components and, for instance in some combinations, with mirror-image turnover tubes. Also, turnover can be achieved upwardly (as shown) or downwardly by appropriate relocation of components and by employment of reversed or reshaped turnover tubes with entry lips 19 (FIG. 2) repositioned to the desired entry position. In the case of a layout for the downward overturning of sheets, a trailing sheet will be imbricated under the leading sheet.

Figure 3:
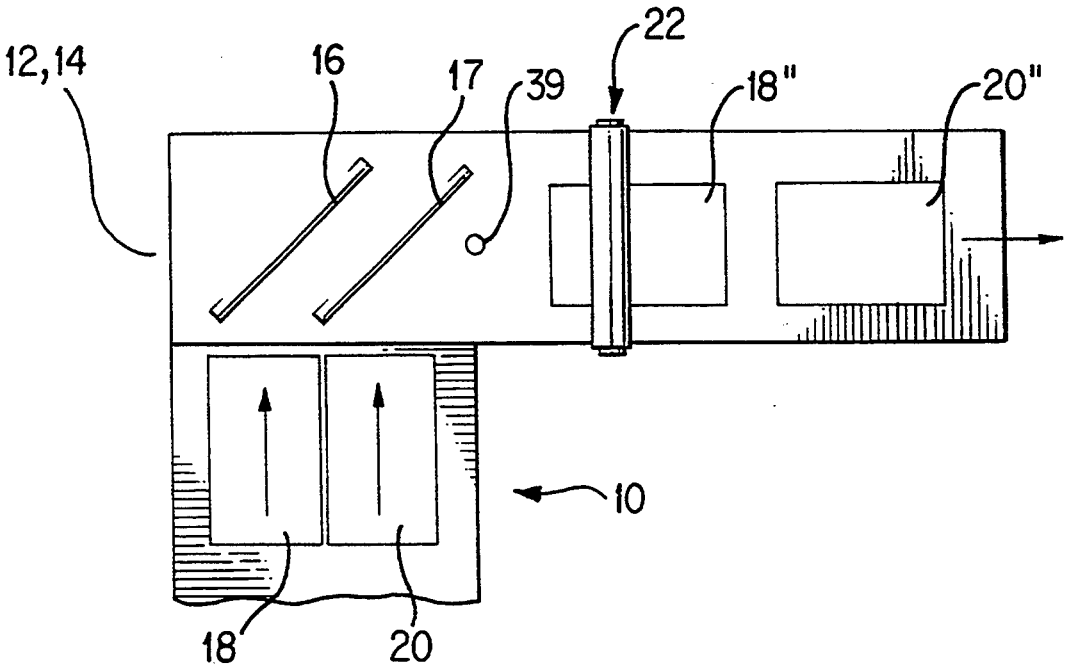
FIG. 3 is a fragmental, schematic, plan, view of an embodiment of the invention including portions depicted in FIGS. 1 and 2.

Referring now to FIG. 3, there is illustrated (in plan view) another embodiment of the invention which, in addition to the components indicated in FIG. 1, comprises means 22 for selectively de-imbricating sheets in their sequential relationship. The illustration of FIG. 3 depicts receiving means 10 feeding two side-by-side sheets 18 and 20 into overturning and rerouting means 12. De-imbricating means 22 is shown disposed just downstream from turnover tube 17 and proximally to a trailing portion of sheet 18''. Sheet 18'' represents sheet 18 subsequent to passage through means 12 (and means 14) and after de-imbrication and separation of sheets 18 and 20 by de-imbricating means 22.

Figure 5:
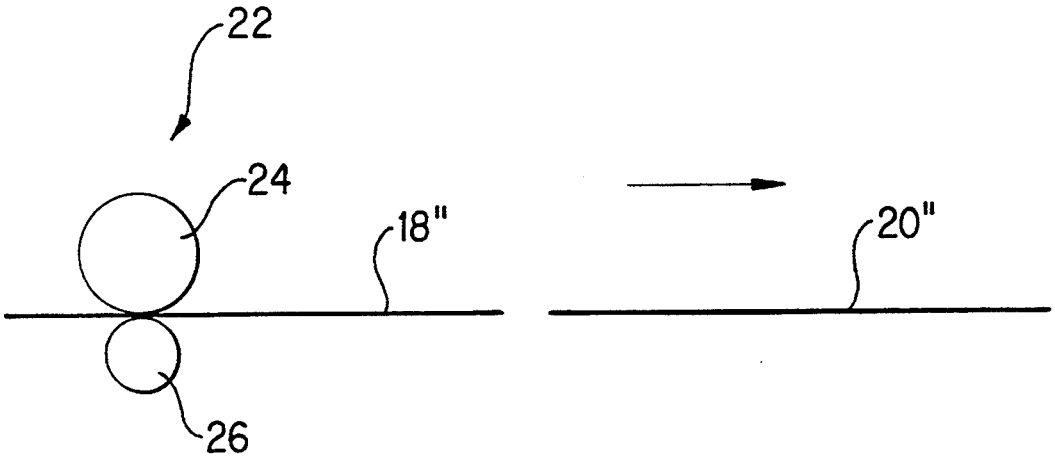
FIG. 5 is a schematic, side view of de-imbricated sheets as indicated in FIG. 3.

De-imbricating means 22 is operative by temporarily braking or stopping the conveying motion of sheet 18. Alternatively, means 22 can be operative by changing (slowing down) the conveying speed of sheet 18 (18' in FIG. 1) so that sheet 20 (20' in FIG. 1), respectively 20'', is conveyed ahead of (and from under) sheet 18'' to thusly de-imbricate and separate the two sheets and to deliver them individually seriatim to further equipment. FIG. 5 further clarifies the relationship between sheets 18'' and 20'' and shows de-imbricating means 22 comprising driven rollers 24 and idler rollers 26 nipping sheet 18'' therebetween. During a selective de-imbricating and separating operation, driven rollers 24 are temporarily slowed down (driven at a slower speed), braked, or stopped.

It will be appreciated that de-imbricating means can be disposed further downstream for engagement and selective temporary speeding up of the leading sheet 20'' in its conveying motion with the same effect of de-imbricating and separating the consecutively conveyed sheets. It should also be understood that de-imbricating of sheets can achieve end-to-end disposition of conveyed sheets or further separation of sheets, as might be needed.

Figure 6:
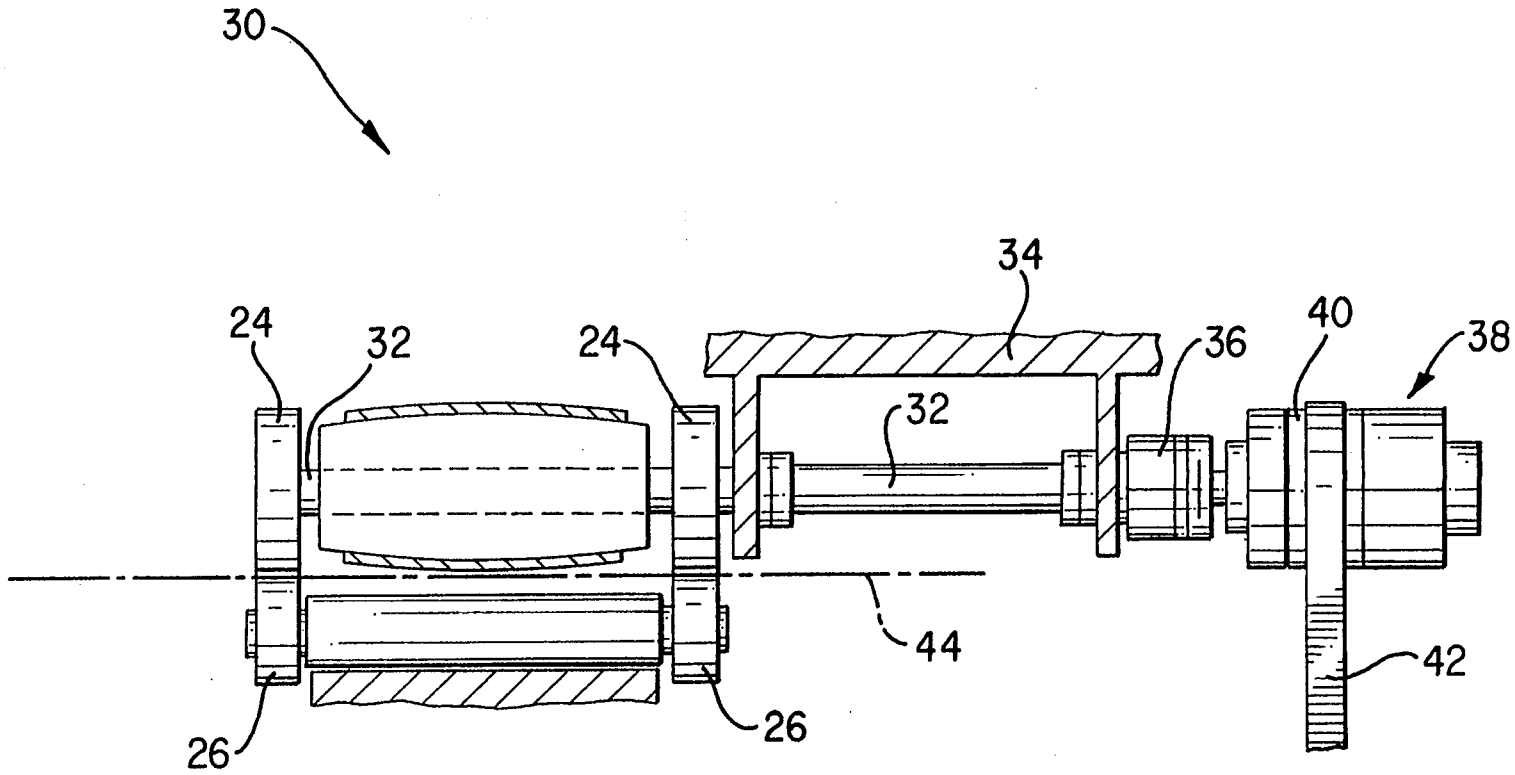
FIG. 6 is a schematic, enlarged, elevation view of portions of an embodiment of the invention that are indicated in FIGS. 3 and 5; and, FIG. 7 is a schematic, enlarged, elevation view of portions of another embodiment of the invention that are indicated FIGS. 3 and 5.

Referring now to FIG. 6, there is illustrated an embodiment of a de-imbricating means that can take the place of de-imbricating means 22 indicated in FIGS. 3 and 5. This de-imbricating means, now designated by numeral 30, includes driven rollers 24 and idler rollers 26. Means 30 further comprises: a common shaft 32 for driving the driven rollers 24; a bearing and support structure 34 (bearing shaft 32); a brake 36 for braking of shaft 32; a clutch 38; a pulley 40; and, a drive belt 42. Clutch 38 serves to couple pulley 40 to shaft 32. In operation, drive belt 42 (driven from a motor source not shown here) drives shaft 32 and therewith rollers 24 via pulley 40 and via clutch 38. Actuation of de-imbricating means 30 by an appropriate electrical signal causes clutch 38 (electrically operated) to disengage pulley 40 from shaft 32 and simultaneously causes brake 36 (electrically operated) to brake shaft 32.

A sheet 44 nipped between rollers 24 and 26 is indicated by a phantom line. It can be visualized that sheet 44, driven by rollers 24, is slowed down or stopped upon actuation of clutch 38 and brake 36. Timing of selective actuation of de-imbricating means 30 is controlled by a sheet sensor 39 (FIG. 3) located in an appropriate position in the sheet path from means 12 and 14.

Figure 7:
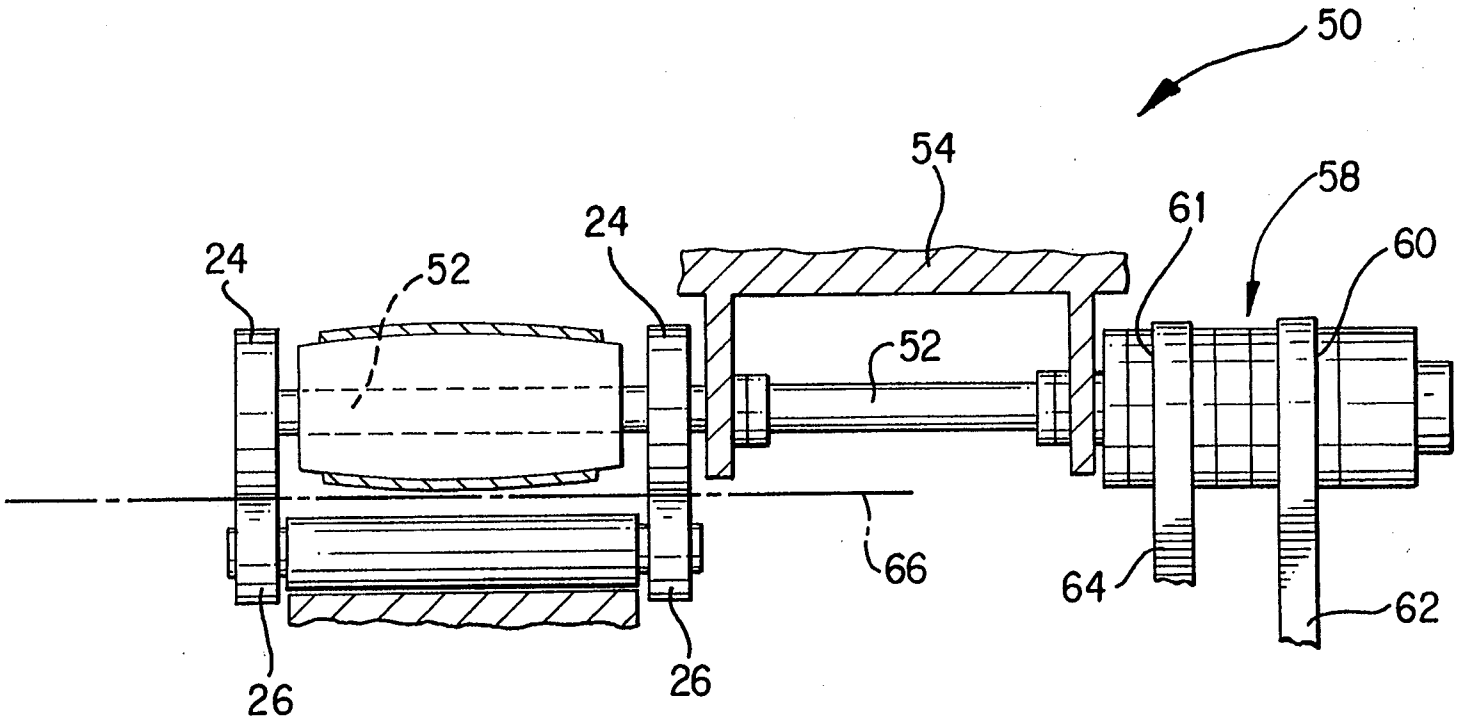

Referring now to FIG. 7, there is illustrated another embodiment of a de-imbricating means that can take the place of de-imbricating means 22 indicated in FIGS. 3 and 5. The de-imbricating means, now designated by numeral 50, includes driven rollers 24 and idler rollers 26. De-imbricating means 50 further comprises: a common shaft 52 for driving of driven rollers 24; a bearing and support structure 54 (bearing shaft 52); a clutch 58; first and second pulleys 60, 61; and, first and second drive belts 62, 64. Clutch 58 serves to couple either pulley 60 or pulley 61 to shaft 52.

In operation, drive belts 62 and 64 (and therewith respective pulleys 60 and 61) are each driven at different speeds (by sources not shown here). Pulley 60 is, for example, driven at a higher speed than pulley 61. Clutch 58 couples pulley 60 to shaft 52 while, simultaneously, pulley 61 is disengaged from shaft 52. Shaft 52 drives rollers 24 and therewith drives the sheet nipped therebetween and the idler rollers 26. The nipped sheet is represented by a phantom line and is designated by numeral 66. Actuation of de-imbricating means 50 by an appropriate electrical signal from sensor 39 causes electrically-operated clutch 58 to disengage pulley 60 from shaft 52 and simultaneously to engage pulley 61 to shaft 32. As pulley 61 is driven at a lower speed than the previously engaged pulley 60, sheet 66 is now slowed down. Timing of selective actuation of de-imbricating means 50 is controlled by the sheet sensor 39 (FIG. 3) located in an appropriate position in the sheet path from means 12 and 14.

The described de-imbricating means 50 can also be employed for selective speeding up of a leading sheet in the output sheet sequence, for example of sheet 20' in FIG. 1, provided the de-imbricating means is appropriately positioned to nip sheet 20' (but not sheet 18'). It will be clear that, in this case, the actuation has to be such as to speed up a nipped sheet (the leading one) in order to de-imbricate sheets. Thus the normally clutch-engaged pulley is the one driven at the lower speed which, upon actuation (to de-imbricate), is disengaged from shaft 52 while the higher-speed pulley is clutch-engaged to shaft 52.

The foregoing has referred to the apparatus of the invention in terms of a function of receiving (at the input) two sheets in side-by-side relationship and providing sequences of two consecutive seriatim-disposed sheets imbricated or selectively de-imbricated and separated. It should be clearly understood that appropriate expansion of the apparatus can provide for input of more than two side-by-side sheets to provide output of sequences of more than two consecutive seriatim-disposed sheets imbricated or selectively de-imbricated and separated.

While the invention has been particularly shown and described with reference to preferred embodiments thereof, it will be understood by those skilled in the art that various changes and modifications in form and details may be made therein without departing from the spirit and scope of the invention.

The embodiments of the invention in which an exclusive property or privilege is claimed are defined as follows:

1. A turnover-sequencer staging apparatus for sheets, comprising:

means for receiving at least two sheets in a side-by-side relationship; and, means for overturning and simultaneously substantially orthogonally rerouting received said at least two sheets, said means for overturning and rerouting including means for converting the side-by-side relationship to a sequential relationship wherein said at least two sheets are disposed seriatim and imbricated.

2. The apparatus according to claim 1, further comprising means for selectively de-imbricating said at least two sheets in the sequential relationship.

3. The apparatus of claim 2, wherein said means for selectively de-imbricating includes means for separating consecutive sheets selectively.

4. The apparatus of claim 3, wherein said means for separating includes means for braking the conveying motion of one of said at least two sheets.

5. The apparatus of claim 3, wherein said means for separating includes means for temporarily stopping the conveying motion of one of said at least two sheets.

6. The apparatus of claim 3, wherein said means for separating includes means for temporarily changing the speed of the conveying motion of one of said at least two sheets.

7. The apparatus of claim 3, wherein said means for separating includes:

roller means for nipping and driving sheets including a roller having a shaft, said roller being drivably mounted upon said shaft, said roller means engaging one of said at least two sheets;

a brake for braking said shaft; and, a clutch for coupling said shaft to a driven pulley;

wherein said brake and said clutch are substantially simultaneously engaged and disengaged, respectively, upon selective actuation of said means for de-imbricating, so that the conveying motion of one of said at least two sheets is retarded.

8. The apparatus of claim 3, wherein said means for separating includes:

roller means for nipping and driving sheets including a roller having a shaft, said roller being drivably mounted upon said shaft, said roller means engaging one of said at least two sheets;

a first pulley driven at a first speed;

a second pulley driven at a second speed; and, a clutch for coupling said shaft to said second pulley while de-coupling said shaft from said first pulley, so that said roller changes from said first speed to said second speed, whereby the speed of the conveying motion of one of said at least two sheets is changed.

9. The apparatus according to claim 1, wherein said means for receiving includes means for cutting a single sheet into said at least two sheets in a side-by-side relationship.

10. A turnover-sequencer staging apparatus for sheets, comprising:

means for receiving at least two sheets in a side-by-side parallel relationship;

means for overturning and simultaneously substantially orthogonally rerouting received said at least two sheets, said means for overturning and rerouting including means for converting the side-by-side relationship to a sequential relationship wherein said at least two sheets are conveyed seriatim and imbricated; and, means for selectively de-imbricating said at least two sheets in the sequential relationship, said means for de-imbricating including means for providing temporarily a conveying speed difference between consecutive sheets of said at least two sheets in the sequential relationship.

11. The apparatus according to claim 10, wherein said means for providing includes means for retarding the conveying motion of a trailing one of consecutive sheets of said at least two sheets in the sequential relationship.

12. The apparatus according to claim 10, wherein said means for providing includes means for slowing down the conveying motion of a trailing one of consecutive sheets of said at least two sheets in the sequential relationship.

13. A turnover-sequencer staging method for sheets, comprising the steps of:

receiving at least two sheets in a side-by-side relationship; and, overturning and simultaneously substantially orthogonally rerouting received said at least two sheets, said step of overturning and rerouting including a step of converting said side-by-side relationship to a sequential relationship having said at least two sheets disposed seriatim and imbricated.

14. The method according to claim 13, further comprising the step of selectively de-imbricating consecutive ones of said at least two sheets in said sequential relationship; and, delivering seriatim selectively de-imbricated said at least two sheets.

15. The method of claim 14, wherein said step of selectively de-imbricating includes the step of separating consecutive sheets selectively.

16. The method of claim 14, wherein said step of selectively de-imbricating includes the step of braking the conveying motion of one of said at least two sheets.

17. The method of claim 14, wherein said step of selectively de-imbricating includes the step of temporarily stopping the conveying motion of one of said at least two sheets.

18. The method of claim 14, wherein said step of selectively de-imbricating includes the step of temporarily changing the speed of the conveying motion of one of said at least two sheets.

19. The method of claim 14, wherein said step of selectively de-imbricating includes the step of temporarily slowing down the speed of the conveying motion of a trailing one of consecutive ones of said at least two sheets.

20. The method of claim 14, wherein said step of selectively de-imbricating includes the step of temporarily increasing the speed of the conveying motion of a leading one of consecutive ones of said at least two sheets.

* * * * *